US007246927B2

(12) United States Patent
Wikle et al.

(10) Patent No.: US 7,246,927 B2
(45) Date of Patent: Jul. 24, 2007

(54) FLUORESCENT FLASHLIGHT

(75) Inventors: David L. Wikle, York, PA (US); Nicholas E. Achterberg, New Freedom, PA (US); William J. Robinson, Ellicott City, MD (US); Lindsay A. Dilley, Arlington, VA (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/294,880

(22) Filed: Dec. 6, 2005

(65) Prior Publication Data

US 2006/0120090 A1 Jun. 8, 2006

Related U.S. Application Data

(60) Provisional application No. 60/688,411, filed on Jun. 8, 2005, provisional application No. 60/634,043, filed on Dec. 7, 2004.

(51) Int. Cl.

| | |
|---|---|
| ***F21V 21/08*** | (2006.01) |
| ***F21V 4/04*** | (2006.01) |
| ***H01R 33/46*** | (2006.01) |
| ***F16B 45/04*** | (2006.01) |

(52) U.S. Cl. ..... 362/396; 362/190; 362/194; 362/651; 248/307

(58) Field of Classification Search ..... 362/396, 362/185, 186, 190, 191, 194, 195, 376–378, 362/399, 400, 651; 248/301, 304, 307, 316.1
See application file for complete search history.

(56) References Cited

U.S. PATENT DOCUMENTS

| | | | | |
|---|---|---|---|---|
| 1,460,394 | A * | 7/1923 | Tweedy | 362/376 |
| 2,245,686 | A * | 6/1941 | Kollath | 362/344 |
| 2,719,967 | A * | 10/1955 | Donley | 362/341 |
| 3,519,489 | A | 7/1970 | Port | |
| 3,746,579 | A | 7/1973 | Port | |
| 3,791,874 | A | 2/1974 | Port | |
| 3,828,181 | A * | 8/1974 | Goodwin | 362/396 |
| 3,875,398 | A | 4/1975 | Brindley | |
| 3,978,330 | A | 8/1976 | Maurer | |
| 4,187,532 | A | 2/1980 | Naffier | |
| 4,369,487 | A * | 1/1983 | Carlow | 362/396 |
| 4,394,716 | A | 7/1983 | Campagna et al. | |
| 4,432,043 | A | 2/1984 | Yuen | |
| 4,598,344 | A | 7/1986 | Nadler | |
| 4,977,489 | A | 12/1990 | Fung | |
| 4,984,141 | A * | 1/1991 | Lai et al. | 362/187 |
| 5,243,505 | A | 9/1993 | Carr | |

(Continued)

FOREIGN PATENT DOCUMENTS

| | | |
|---|---|---|
| DE | 1682257 | 8/1954 |

(Continued)

*Primary Examiner*—Alan Cariaso
(74) *Attorney, Agent, or Firm*—Harness, Dickey & Pierce, P.L.C.

(57) ABSTRACT

A portable light is provided with a hook cylinder assembly which includes a retracting hook rod connected to a rotor assembly. The hook rod and rotor assembly can be rotated and held in position with respect to a remainder of the hook cylinder assembly. A hook located at an end of the hook rod can thus be oriented in a desired direction.

9 Claims, 12 Drawing Sheets

U.S. PATENT DOCUMENTS

| | | | | | |
|---|---|---|---|---|---|
| 5,278,740 | A | * | 1/1994 | Agnelli | 362/649 |
| 5,301,912 | A | * | 4/1994 | Chang | 248/304 |
| 5,465,196 | A | | 11/1995 | Hasenberg et al. | |
| 5,519,593 | A | * | 5/1996 | Hasness | 362/186 |
| 5,521,595 | A | * | 5/1996 | Totten et al. | 362/186 |
| 5,528,477 | A | | 6/1996 | Carmo | |
| D393,324 | S | | 4/1998 | Howard et al. | |
| 5,765,941 | A | | 6/1998 | Vest | |
| 5,897,199 | A | | 4/1999 | Norris | |
| D409,776 | S | | 5/1999 | Ghode et al. | |
| 5,921,658 | A | * | 7/1999 | Kovacik et al. | 362/199 |
| 5,924,667 | A | * | 7/1999 | Grahn et al. | 248/304 |
| D414,576 | S | | 9/1999 | Yuen | |
| 5,988,828 | A | * | 11/1999 | Prince et al. | 362/191 |
| 6,123,434 | A | | 9/2000 | Meltzer | |
| D441,888 | S | * | 5/2001 | Haneda et al. | D26/42 |
| 6,364,504 | B1 | * | 4/2002 | Hon | 362/190 |
| 6,598,993 | B1 | * | 7/2003 | Dalton et al. | 362/202 |
| 6,601,814 | B2 | | 8/2003 | Kovacik et al. | |
| D486,257 | S | | 2/2004 | Kingston et al. | |
| 6,761,467 | B2 | * | 7/2004 | Matthews et al. | 362/202 |
| D501,687 | S | | 2/2005 | Kovacik et al. | |
| 6,857,756 | B2 | * | 2/2005 | Reiff et al. | 362/191 |
| 6,902,293 | B2 | | 6/2005 | Tang | |
| 2006/0221615 | A1 | * | 10/2006 | Bayat et al. | 362/399 |

FOREIGN PATENT DOCUMENTS

| | | | |
|---|---|---|---|
| DE | 1866798 | | 2/1963 |
| DE | 1921616 | | 8/1965 |
| DE | 2444221 | | 3/1975 |
| DE | 2343274 | C3 | 12/1978 |
| DE | G8701423.8 | | 5/1987 |
| DE | 3711174 | A1 | 12/1988 |
| DE | 3922024 | A1 | 1/1991 |
| DE | 4036632 | A1 | 6/1991 |
| DE | 4107148 | A1 | 10/1991 |
| DE | 4040183 | A1 | 6/1992 |
| DE | 4140766 | A1 | 6/1993 |
| DE | G9302706.0 | | 9/1993 |
| DE | 4306368 | A1 | 9/1994 |
| DE | 29507501 | U1 | 8/1995 |
| DE | 19602944 | A1 | 8/1996 |
| DE | 29520154 | U1 | 8/1996 |
| DE | 29607177 | U1 | 1/1997 |
| DE | 29814312 | U1 | 1/1999 |
| DE | 29822168 | U1 | 5/1999 |
| DE | 29906502 | U1 | 9/1999 |
| DE | 10209032 | A1 | 9/2003 |
| WO | WO-00/57103 | | 9/2000 |

* cited by examiner

FLUORESCENT FLASHLIGHT

CROSS-REFERENCE TO RELATED APPLICATIONS

This application claims the benefit of U.S. Provisional Application No. 60/634,043, filed on Dec. 7, 2004 and claims the benefit of U.S. Provisional Application No. 60/688,411, filed on Jun. 8, 2005. The disclosures of the above applications are incorporated herein by reference.

FIELD OF THE INVENTION

The present invention relates to portable electric lamps, and more particularly, to a fluorescent flashlight having a retractable hook for suspending the lamp from a support and a rechargeable battery pack.

BACKGROUND OF THE INVENTION

Portable lamps, e.g. shop lights, flashlights, and lanterns, often have hooks (or loops) that can be used to suspend the lamps from a support. Some of these hooks are integrally formed with a body of the lamp and thus have a fixed position with respect to the light source. This can make it undesirably challenging to locate a support that is at the right location and orientation to hold the lamp in a desired position.

In an effort to solve this issue with integrally formed hooks, some lamps include a hook that rotates or swivels with respect to the lamp body. While such a hook arrangement makes it easier to locate a suitable support for the lamp and task at hand, it also has at least one undesirable aspect. For example, jostling or other external influences can cause the lamp to rotate about the hook and remove light from the task at hand. Also, the hooks typically protrude from the bodies of the lamps and therefore may undesirably snag on objects. The protruding hooks are also prone to being bent or broken while the lamps are stored or transported.

SUMMARY OF THE INVENTION

A portable lamp has a hook cylinder assembly that includes a retracting hook rod connected to a rotor assembly. The hook rod and rotor assembly can be rotated and held in position with respect to a remainder of the hook cylinder assembly. A hook located at an end of the hook rod can thus be oriented in a desired direction. In an aspect of the disclosure, the portable lamp is a fluorescent flashlight.

In an aspect of the invention, a fluorescent flashlight has a base and lamp housing that twist together with a bayonet type coupling to hold the lamp housing to the base.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
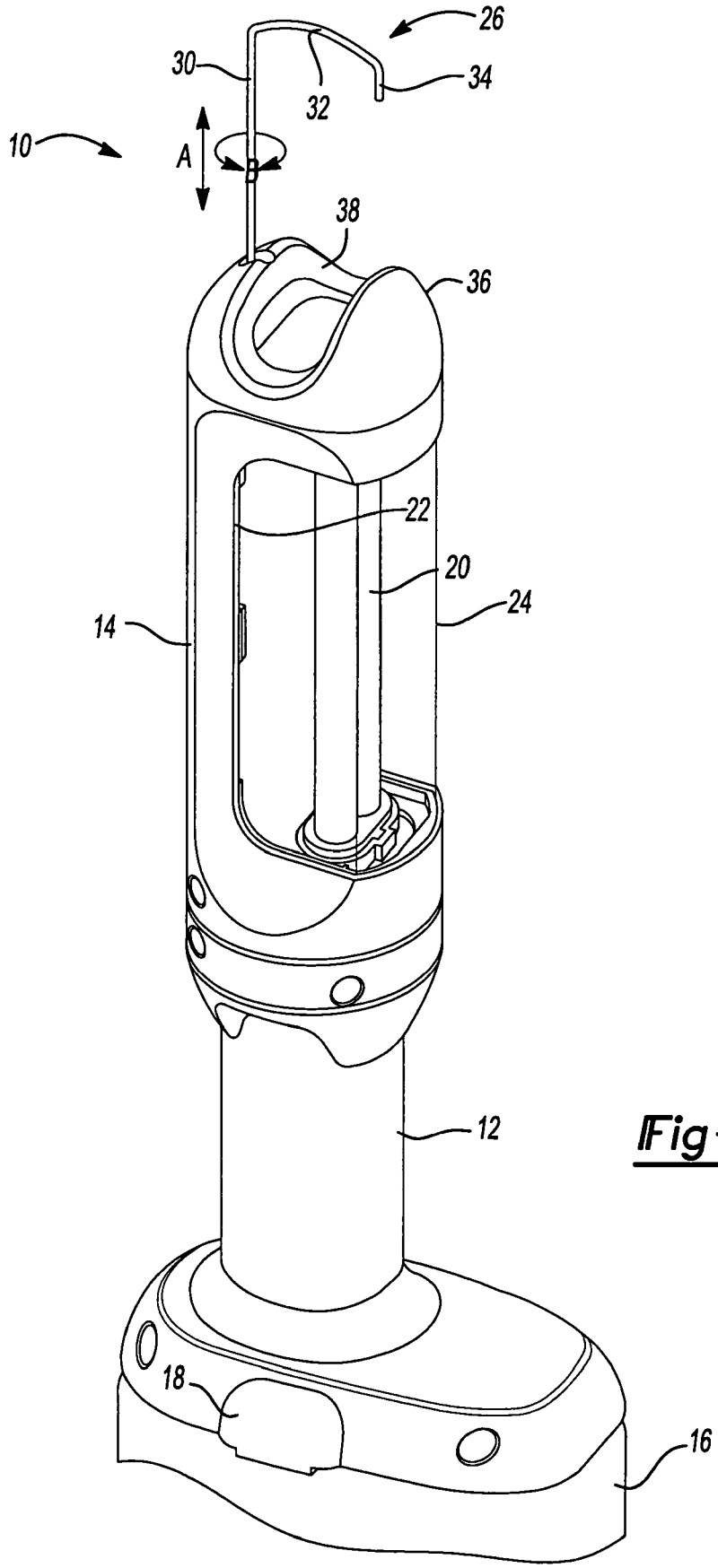
FIG. 1 depicts a perspective view of a portable lamp.

Referring now to FIG. 1, a perspective view of a portable lamp 10 is shown. A portable lamp 10 includes a base housing 12 attached to a lamp housing 14. In some embodiments, the base housing 12 can be integrally formed with the lamp housing 14. The base housing 12 is adapted to receive a battery 16. In some embodiments, the battery 16 is a rechargeable battery. The base housing 12 can include at least one catch 18 that retains the battery 16.

The lamp housing 14 surrounds a light source 20, such as a fluorescent tube, an incandescent lamp, a light emitting diode, or an electroluminescent panel. The lamp housing 14 includes an opening 22 that exposes the light source 20. A translucent lens 24 covers the opening 22 and the light source 20.

The lamp housing 14 includes a retractable hook assembly 26. Retractable hook assembly 26 includes a hook cylinder assembly 28 (FIGS. 2 and 4) mounted within the lamp housing 14. A hook rod 30, having a hook 32 at a distal end, is retractably received in hook cylinder assembly 28 and can be axially retracted into and extended from the lamp housing as indicated by the arrows A-A. The hook rod 30 can also be rotated within the lamp housing 14 as indicated by the curved arrows B-B. Hook 32 may have a distal end 34 that is bent so that it extends axially toward lamp housing 14 and can engage a receptacle 36 in the lamp housing 14 when the hook rod 30 is fully retracted. When the hook rod 30 is fully retracted, the hook 32 spans a finger groove 38 formed in the lamp housing 14.

Hook cylinder assembly 28 includes components that facilitate extending, retracting, locking hook rod 30 in one of several rotational positions, and rotating the hook rod 30 with respect to the lamp housing 14, as described more fully below. The hook 32 can also be used to hang the portable lamp 10 from a suitable support when the hook rod 30 is extended from the lamp housing 14.

Figure 2:
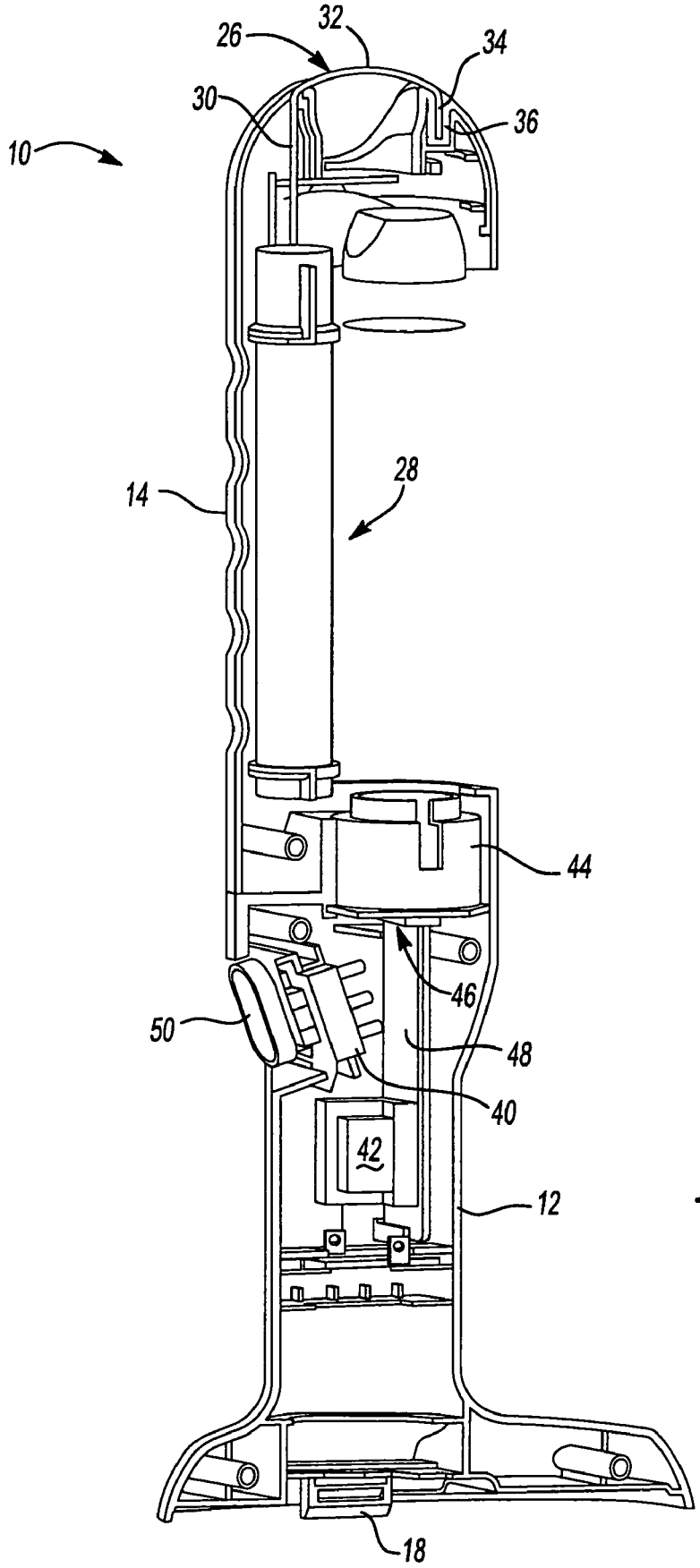
FIG. 2 depicts an interior perspective view of a portable lamp.

Turning now to FIG. 2, an interior perspective view of the portable lamp 10 is shown. The base housing 12 contains electrical components, e.g. a switch 40, a ballast 42, and a lamp socket 44 having terminals 46. The electrical components are connected to form a circuit that selectively applies power to the light source 20. Some or all of the electrical components can be mounted on a printed circuit board (PCB) 48. A lamp or bulb, which may illustratively be light source 20, is illustratively plugged into lamp socket 44. In some embodiments, the light source 20 can be connected directly to the circuit without using the lamp socket 44. Such an embodiment may be desirable when the light source 20 is formed from LEDs or an electroluminescent panel.

A switch cover 50 covers the switch 40 and has a periphery that slidingly engages a periphery of a switch opening in the base housing 12. The switch cover 50 reduces a possibility of debris entering the base housing 12 through the switch opening.

Figure 3:
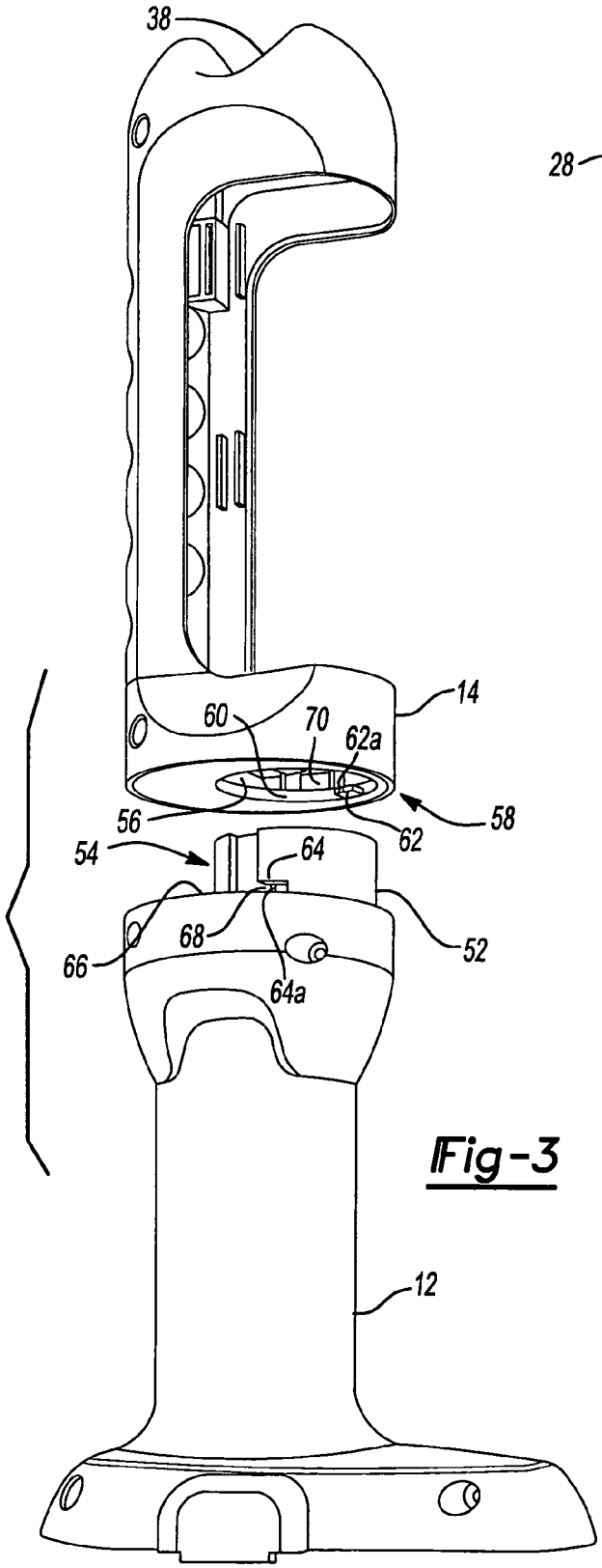
FIG. 3 depicts a bayonet coupling that connects and aligns a housing portion and a lamp housing portion of the portable lamp.

In an embodiment, base housing 12 and lamp housing 14 may illustratively be separate assemblies that are secured together. In this regard, base housing 12 and lamp housing 14 may illustratively be secured together by a bayonet coupling as shown in FIG. 3. The bayonet coupling permits the lamp housing 14 to be removed from the base housing 12 to facilitate replacing the light source 20. The bayonet coupling includes corresponding mating portions of base housing 12 and lamp housing 14. More specifically, base housing 12 includes a cylindrical portion 52 at a distal end 54 that slips into a cylindrical recess 56 in a proximal end 58 of lamp housing 14 defined by an interior wall 60. Interior wall 60 includes radially inwardly pointing projections 62. The projections 62 mate with recessed grooves 64 formed in the cylindrical portion 52 of the base housing 12.

The lamp housing 14 attaches to the base housing 12 by first aligning the projections 62 with the recessed grooves 64. The cylindrical portion 52 of base housing 12 is then inserted in the cylindrical recess 56 until the projections 62 abut corners 66 of the grooves 64. The lamp housing 14 is then rotated until the projections 62 stop against ends 68 of the grooves 64. The grooves 64 can have a screw pitch between the corners 66 and the ends 68 to tightly draw the lamp housing 14 against the base housing 12. The projections 62 are preferably angled at the same pitch as between the corners 66 and the ends 68. The projections 62 can have a beveled leading edge 70 to facilitate sliding through the grooves 64. The projections 62 may further have a protruding rib 62A that lockingly engages a corresponding rib 64A disposed in the groove 64 to snap-lock the lamp housing 14 to the base housing 12.

Figure 4:
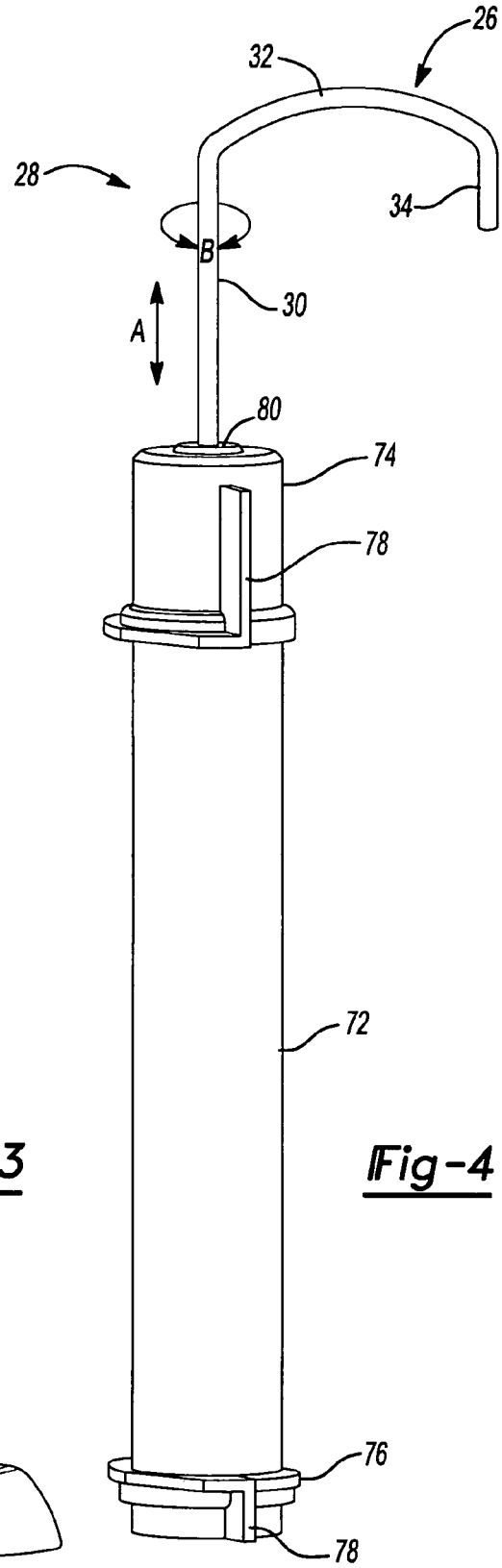
FIG. 4 depicts a hook cylinder assembly.

Turning to FIG. 4, hook cylinder assembly 28 is described in greater detail. Hook cylinder assembly 28 includes a cylindrical housing 72 that has a first end closed by a first cover 74 and a second end closed by a second cover 76. The first and second covers 74, 76 can include alignment features 78. The alignment features 78 engage mating features (not shown) formed in the interior of the lamp housing 14 and locate the hook cylinder assembly 28 therein. The hook rod 30 protrudes through an aperture 80 in the first cover 74 and slides axially in and out of the housing 72. The hook rod 30 can also rotate axially with respect to the housing 72 and the first and second covers 74, 76.

Figure 5:
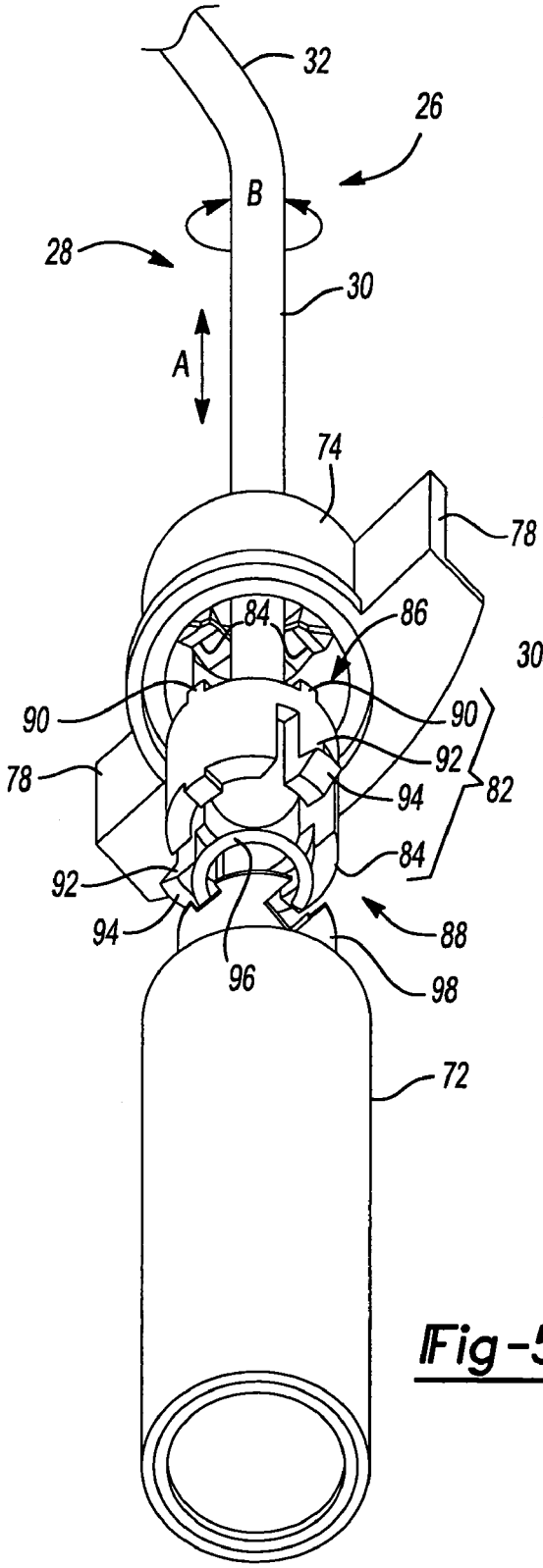
FIG. 5 depicts a rotor assembly than can be used with the hook cylinder assembly of FIG. 4.

Turning now to FIG. 5, hook cylinder assembly 28 further includes a rotor assembly 82. Rotor assembly 82 includes a generally cylindrical rotor 84 having a closed end 86 and an open end 88. A periphery of the closed end 86 includes at least one orientation projection 90 that extends in an axial direction away from the rotor 84. The hook rod 30 is secured, such as by insert molding or with a fastener, to a center of the closed end 86 of the rotor 84. A curved wall of the rotor 84 includes at least one locking finger 92 having a first end proximate the closed end 86 and integrally formed with the curved wall and a second end having a radially outward pointing catch 94.

A bias element, which may illustratively be a split metal ring 96, fits radially within an inner diameter of the rotor 84 and engages a groove formed in a radially inwardly facing wall of the locking finger(s) 92 radially inward of the catch 94. The split metal ring 96 biases the catch 94 radially outward from the rotor 84. A rotor cover 98 fits in the open end 88 of the rotor 84.

The rotor assembly 82 slides axially into the first cover 74. The first cover 74 attaches to the first end of the housing 72.

Figure 6:
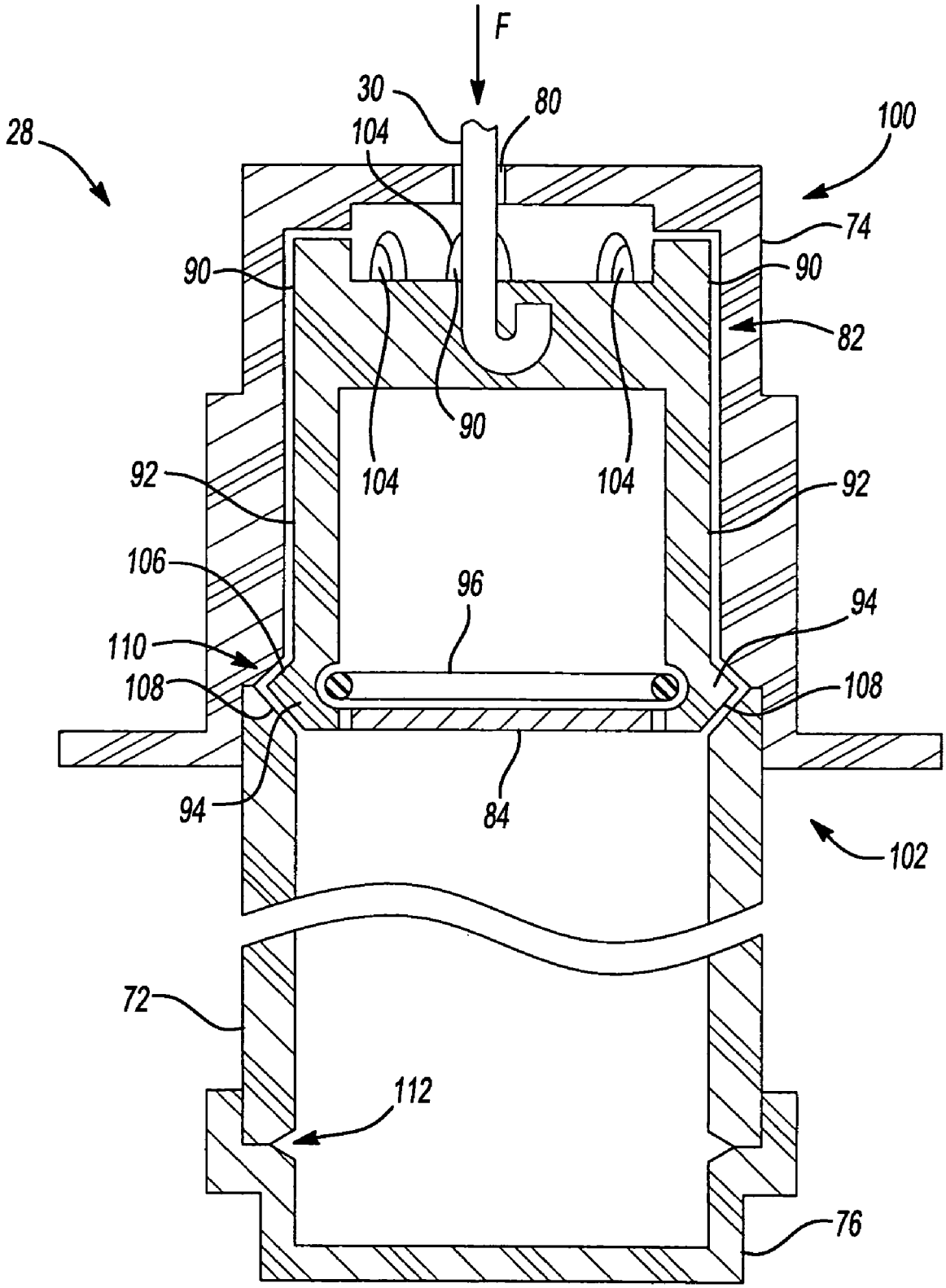
FIG. 6 depicts a cross section of a hook cylinder assembly.

Turning now to FIG. 6, a cross section along the axial length of the hook cylinder assembly 28 is shown. The first cover 74 has a cylindrical interior including a closed end 100 through which aperture 80 extends and an open end 102. The hook rod 30 passes through the aperture 80 in the closed end 100. An interior periphery of the closed end 100 includes a plurality of axially extending detents 104. The detents 104 are preferably shaped to match a profile of the at least one orientation projection 90 formed on the rotor 84. The detents 104 are preferably equally and radially spaced about the interior periphery of the closed end 100. In some embodiments, the detents 104 are equally and radially spaced 45 degrees apart with respect to an axial center of the hook rod 30. The at least one orientation projection 90 of rotor 84 engages a selected subset of the detents 104 when the rotor 84 is slid inside of the first cover 74 up against the detents 104. The rotational orientation of the hook rod 30, and hence the hook 32, is determined by which subset of the detents 104 the at least one orientation projection 90 engages.

Rotor assembly 82 is held within first cover 74 by locking finger(s) 92. A surface of open end 102 of the first cover 74 is chamfered at 106 and a surface of the first end of housing 72 is chamfered at 108. The chamfers 106, 108 cooperate to form a groove 110. The catch 94 of locking finger(s), urged radially outwardly by split metal ring 96, engages the groove 110 and holds the rotor 84 axially in position at the first end of the housing 72. In this position, the hook rod 30 is fully extended and its rotational orientation is determined by the subset of detents 104 engaged by the at least one orientation projection 90 of rotor 84.

To retract hook rod 30 into the housing 72, sufficient force is exerted on it in the direction F to overcome the spring force exerted by split metal ring 96 on locking finger(s) 92 to dislodge catch 94 from the groove 110. Once this occurs, the rotor 84 slides axially towards the second end of the housing 72. The at least one orientation projection. 90 withdraws from the subset of detents 104, allowing the rotor assembly 82, hook rod 30 and hook 32 to rotate freely. This facilitates positioning the distal end 34 of hook 32 in the receptacle 36 of lamp housing 14 as the hook rod 30 approaches the fully retracted position. It also facilitates orienting hook rod 30 in the proper rotational orientation as hook rod 30 is extended. When the rotor assembly 82 reaches the second end of the housing 72, the catch 94 of locking finger(s) 92 engages a second groove 112 formed by the cooperation of chamfered surfaces of the second end of the housing 72 and an open end of the second cover 76. The catch 94 holds the rotor assembly 82 in position at the second end of the housing 72 until the hook rod 30 is pulled in a direction opposite the direction F. When the pulling force is sufficient to dislodge the catch 94 from the second groove 112, the rotor assembly 82 will slide back towards the first end of the housing 72.

Figure 7A:
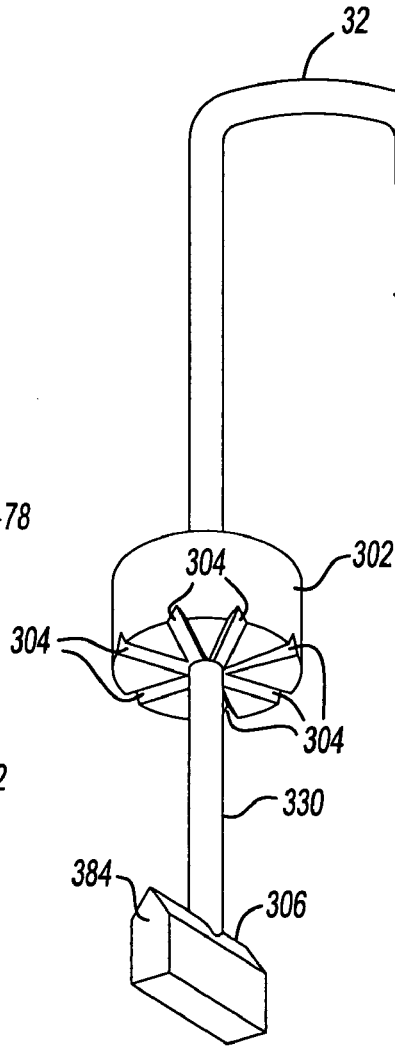
FIG. 7A depicts an alternate hook assembly in a disengaged position.

Turning now to FIG. 7A, an alternate hook assembly 300 is shown. The hook assembly 300 includes a cylindrical stopper 302 having transverse slots 304. The transverse slots 304 are preferably distributed with a constant angle, such as 45 degrees, between each of the transverse slots 304. A hook rod 330 passes coaxially through the stopper 302 and includes a transverse rotor 384 at an end opposite of the hook 32. The transverse rotor 384 includes a narrowed edge 306 that can engage one of transverse slots 304. The cylindrical stopper 302 and the transverse rotor 384 are parts of a latch of the hook assembly 300.

The alternate hook assembly 300 can be positioned in the lamp housing 14 in place of the hook cylinder assembly 28. The cylindrical stopper 302 and the lamp housing 14 are adapted to securely locate the cylindrical stopper 302 within the lamp housing 14. The hook rod 330 slides through the cylindrical stopper 302 to extend and retract the hook 32 with respect to the lamp housing 14.

Figure 7B:
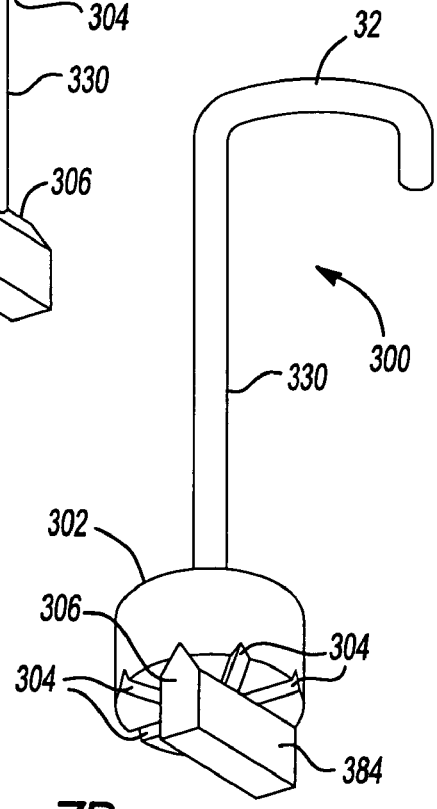
FIG. 7B depicts the alternate hook assembly of FIG. 7A in an engaged position.

Turning now to FIG. 7B, the alternate hook assembly 300 is shown in an engaged position. The hook 32 is fully extended such that the hook rod 330 urges the transverse rotor 384 against the cylindrical stopper 302. The narrowed edge 306 engages one of transverse slots 304 and prevents the hook rod 330 from rotating. The hook 32, which is fixedly connected to the hook rod 330, is thereby held in a selected position.

Figure 8:
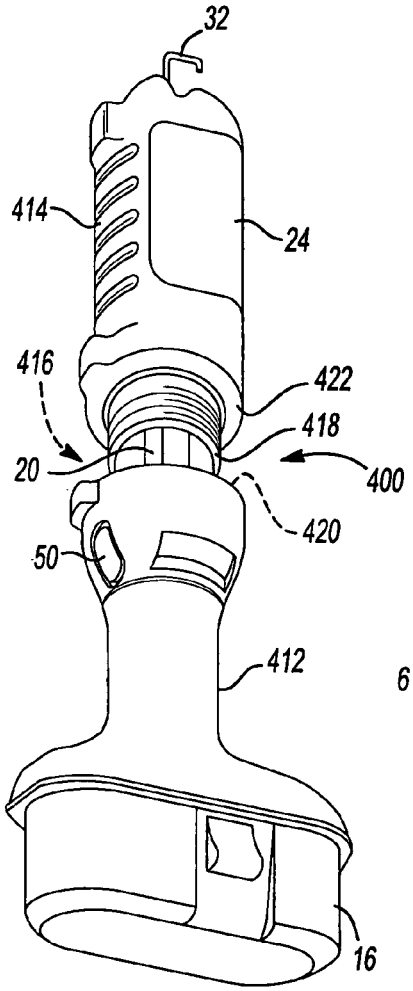
FIG. 8 depicts a threaded coupling that connects and aligns a housing portion and a lamp housing portion of the portable lamp.

Turning now to FIG. 8, a threaded coupling 400 is shown that connects and aligns a base housing 412 and a lamp housing 414. The base housing 412 includes a coaxial threaded opening 416 extending into base housing 412 through an end 420 of base housing 412. The lamp housing 414 includes a coaxial threaded extension 418 and a shoulder 422 extending radially outwardly from coaxial threaded extension 418. A center portion of the coaxial threaded extension 418 is open and allows the bulb 20 to extend into the lamp housing 414.

The lamp housing 414 is assembled to the base housing 412 by turning the lamp housing 412 and threading the coaxial threaded extension 418 into the coaxial threaded opening 416. The lamp housing 414 and the base housing 412 are assembled when end 420 of base housing 412 abuts shoulder 422 of lamp housing 414.

Figure 9:
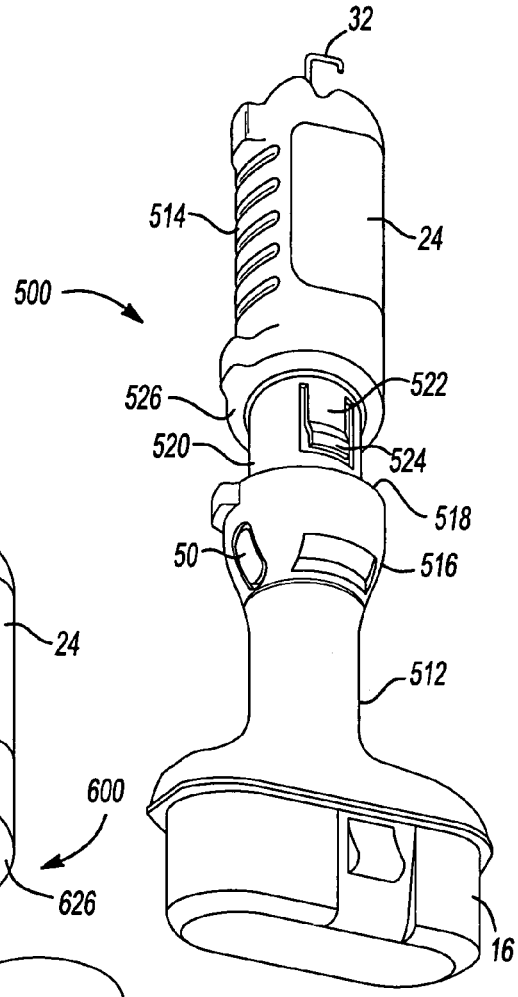
FIG. 9 depicts a catch coupling that connects and aligns a housing portion and a lamp housing portion of the portable lamp.

Turning now to FIG. 9, a catch coupling 500 is shown that connects and aligns a base housing 512 and a lamp housing 514. The base housing 512 includes a plurality of axial curved slots 516 and a rim 518. The lamp housing 514 includes a coaxial cylindrical extension 520. A plurality of radially pliable tangs 522 are formed into the coaxial cylindrical extension 520 and align with the plurality of axial curved slots 516 formed in the base housing 512. A catch 524 is formed at an end of each of the plurality of radially pliable tangs 522. A radially extending ledge 526 is formed between the coaxial cylindrical extension 520 and the lamp housing 514.

The lamp housing 512 is assembled to the base housing 514 by inserting the plurality of radially pliable tangs 522 in the plurality of axial curved slots 516. The lamp housing 512 and the base housing 514 are then urged together until the catches 524 engage peripheries of the plurality of axial curved slots 516. The rim 518 abuts the radially extending ledge 526 when the lamp housing 512 and the base housing 514 are assembled.

Figure 10:
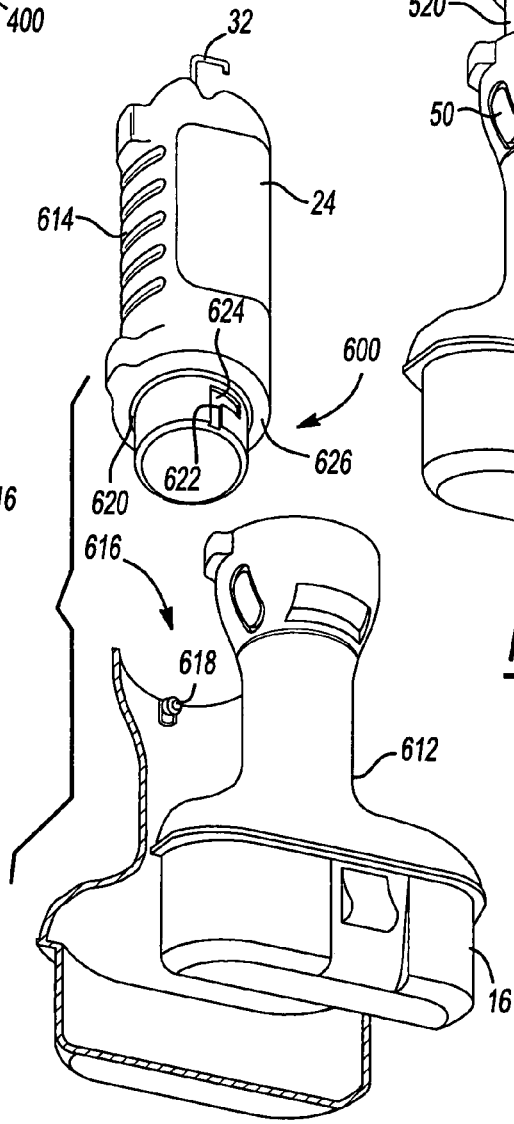
FIG. 10 depicts an alternate bayonet coupling that connects and aligns a housing portion and a lamp housing portion of the portable lamp.

Turning now to FIG. 10, an alternate bayonet coupling 600 is shown that connects and aligns a base housing 612 and a lamp housing 614. The base housing 612 includes a coaxial cylindrical opening 616. A plurality of pins 618 are integrally formed with the base housing 612 and extends radially into the coaxial cylindrical opening 616. The lamp housing 614 includes a coaxial cylindrical extension 620. The coaxial cylindrical extension 620 includes a plurality of L-shaped grooves 622 that align with the plurality of pins 618.

The lamp housing 614 is assembled to the base housing 612 by inserting the coaxial cylindrical extension 620 into the cylindrical opening 616 while aligning the plurality of pins 618 and plurality of L-shaped grooves 622. The base housing 612 and the lamp housing 614 are then urged together until the plurality of pins 618 abuts corners 624 in the plurality of L-shaped grooves 622. The base housing 612 and the lamp housing 614 are then rotated with respect to each other until the plurality of pins 618 abut ends 626 of the plurality of L-shaped grooves 622.

The lamp housings 414, 514, and 614 can be adapted with either the hook cylinder assembly 28 or the hook assembly 300 to provide the extending and rotating hook 32.

Figure 11:
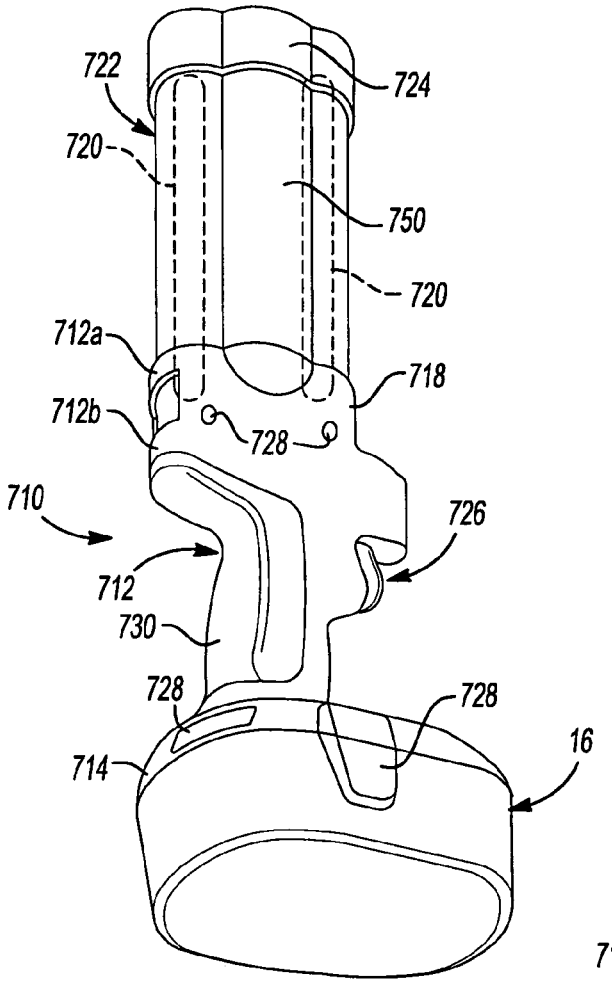
FIG. 11 is a perspective view of the cordless light according to a further embodiment of the present disclosure.
Figure 12:
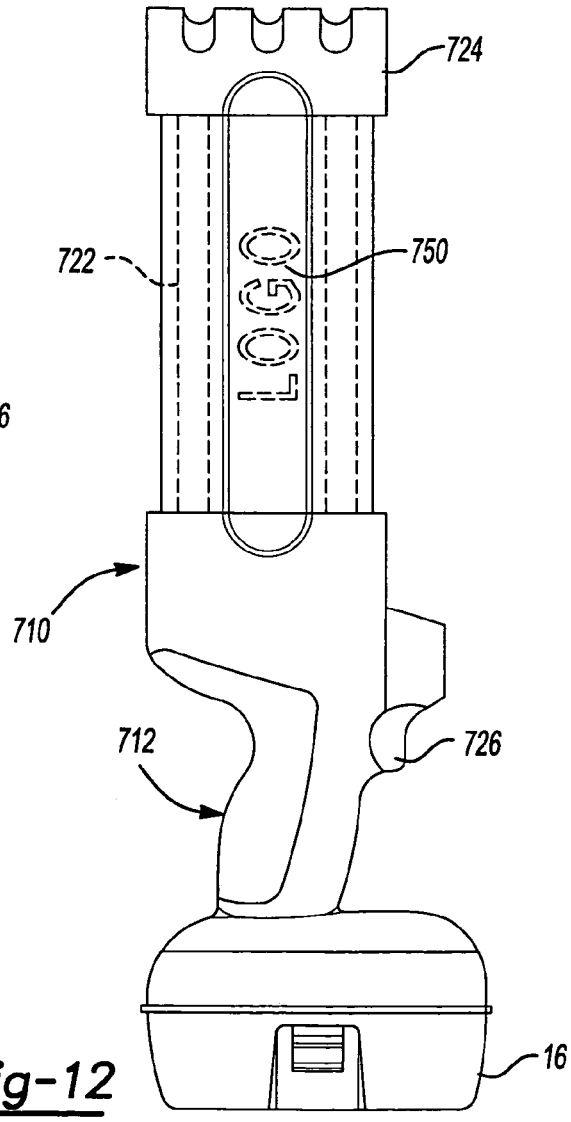
FIG. 12 is a side view of the cordless light shown in FIG. 11.
Figure 13:
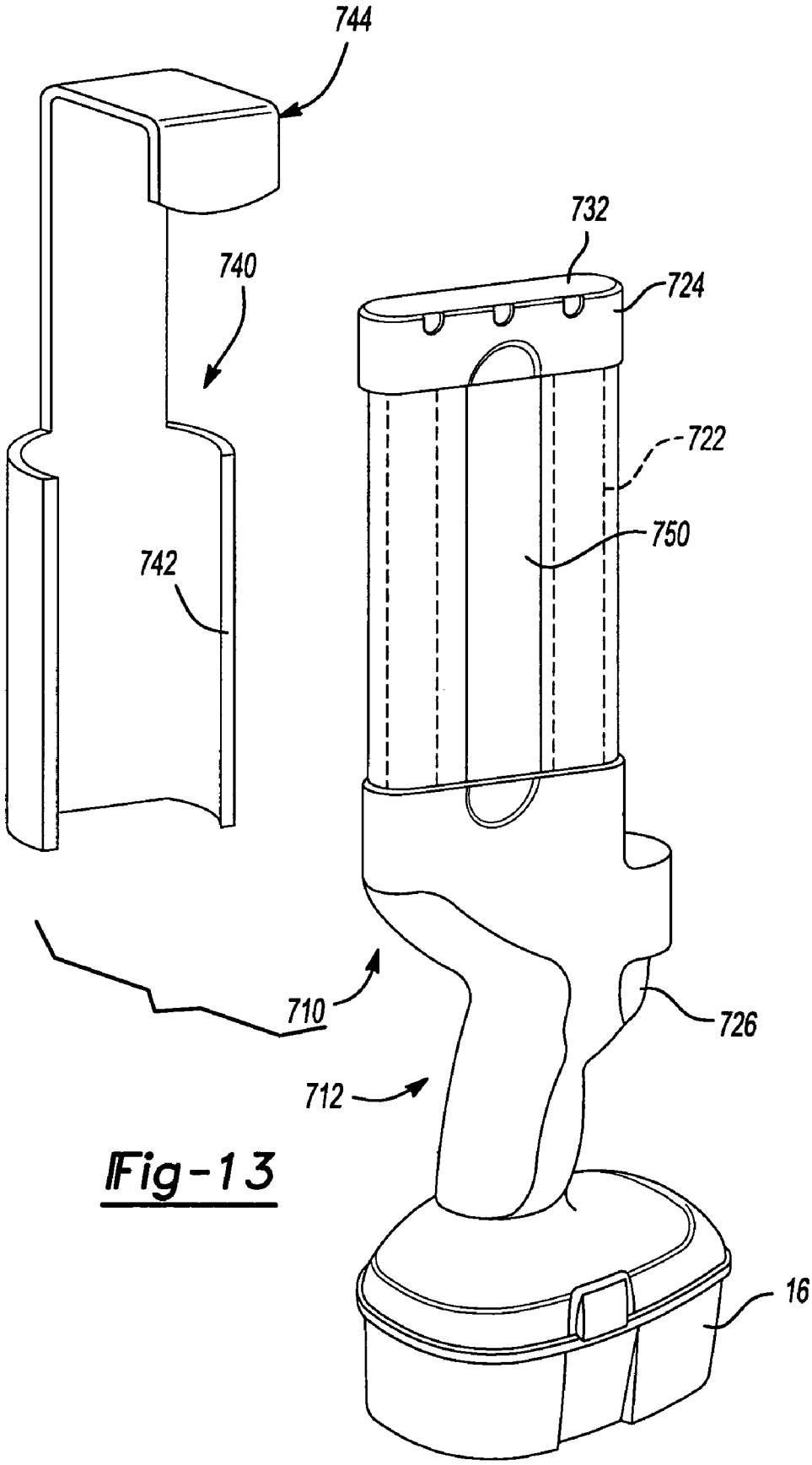
FIG. 13 is a perspective view of the cordless light of FIG. 11 shown in an upright position and illustrating an integral shade and hook that attaches to the cordless light according to the principles of the present disclosure.

With reference to FIGS. 11-13, a further embodiment of the cordless light 710 will now be described. The cordless light 710 includes a handle 712 having a first end 714 connected to a battery pack 16 and a second end 718 adapted to receive a pair of bulbs 720 and a lens 722. A rubber cap 724 is disposed over a second end of the lens 722 and serves as a protective bumper.

The handle portion 712 includes a trigger 726 that activates a switch (not numbered) for providing an electrical connection between the battery 716 and the bulbs 720. The handle 712 is configured like a pistol grip of a drill. The first end 714 of the handle 712 is adapted to receive the battery pack 16. The battery pack 16 is provided with side latches 728 which releasably engage the handle portion 712 for holding the battery in connection with the handle 712, as is well known in the art. The second end 718 of the handle 712 is provided with a pair of bulb receptacles (not shown) for receiving bulbs 720 therein. The second end 718 of the handle 712 includes a recessed portion that receives the lens 722 in a snap-fit engagement. Alternatively, the lens 722 can be secured in place by a fastener or can be encapsulated by the first and second clam shell halves 712A, 712B of the handle 712 during assembly thereof. The clam shell halves 712A, 712B of the handle 712 are held together by a plurality of screws (not shown) received in bosses 728. The handle 712 includes a rubber grip portion 730 provided on the back surface thereof which is engaged by the palm of a user's hand.

The lens 722 is preferably made of a clear plastic and is generally oval in cross section so as to accommodate two bulbs 720 in side by side relation. The protective bumper 724 is attached to the end of the lens 722 and is preferably made of a rubber or other elastomeric material. The bumper 724 is provided with a secondary lens 732 (FIG. 13) in the end portion thereof to allow light to pass therethrough in order to function as a flashlight in order to direct a beam of light therethrough. The protective bumper 724 is press fit onto the end of the lens 722. The bulbs 720 are preferably fluorescent bulbs, but other bulbs can also be utilized.

The cordless light 710 can be utilized as a lantern for providing sufficient light to light a large area and can also be utilized as a flashlight to direct a beam of light in a specific area. The cordless light 710 does not require any exterior source of electricity and can be operated utilizing standard battery packs that are used on various power tools on a job site.

As shown in FIG. 13, a shade 740 is provided including a generally C-shaped body 742 which is snap-fit on the lens 722 for blocking one side of the lens 722 in order to direct light in a desired direction. The shade 740 can be provided with a reflective coating in order to magnify the light directed in the desired direction. A hook 744 is formed integrally with the shade 740 which allows the light 710 to be suspended therefrom.

Figure 14:
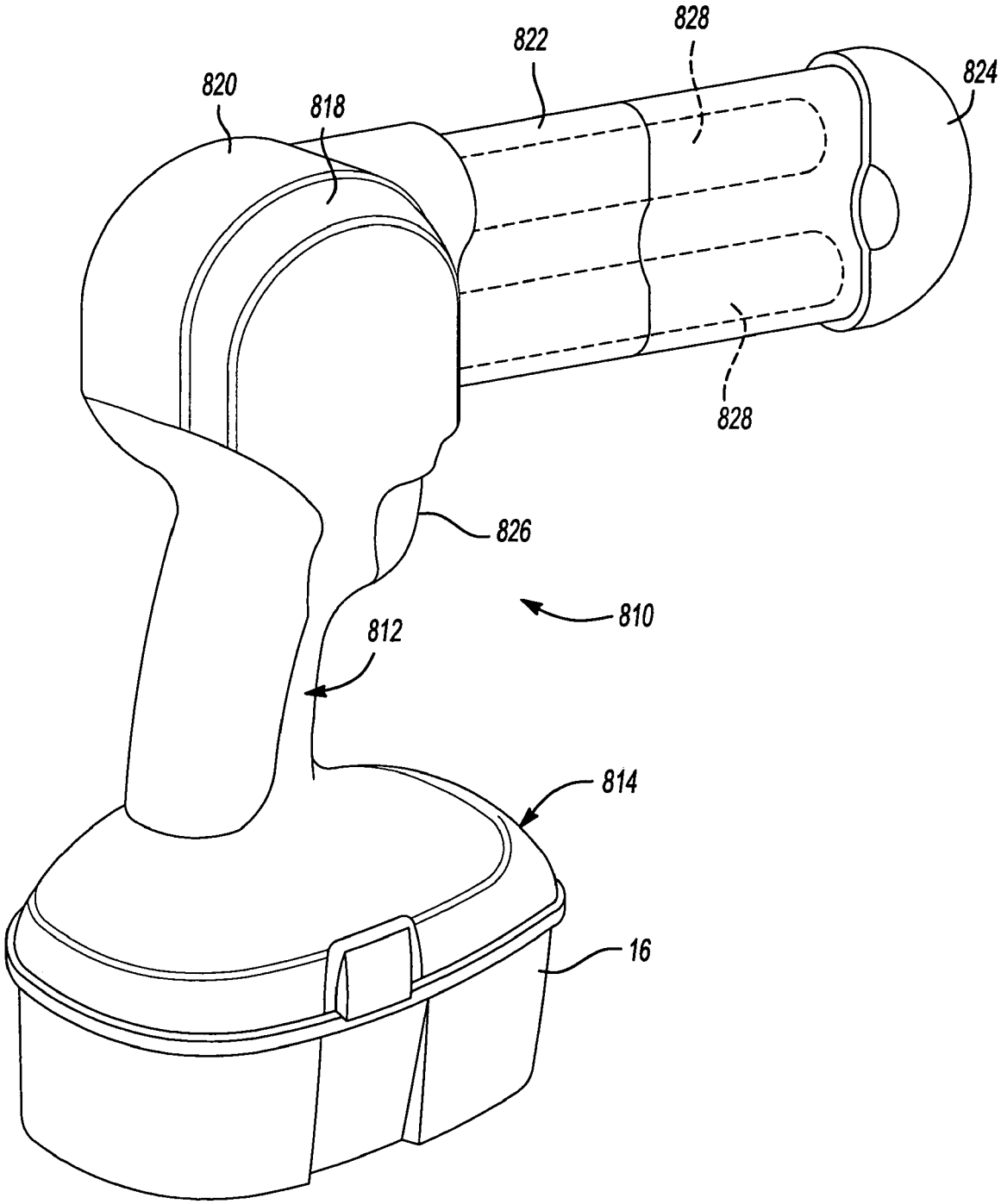
FIG. 14 is a perspective view of a cordless light according to a still further embodiment of the present disclosure.
Figure 15:
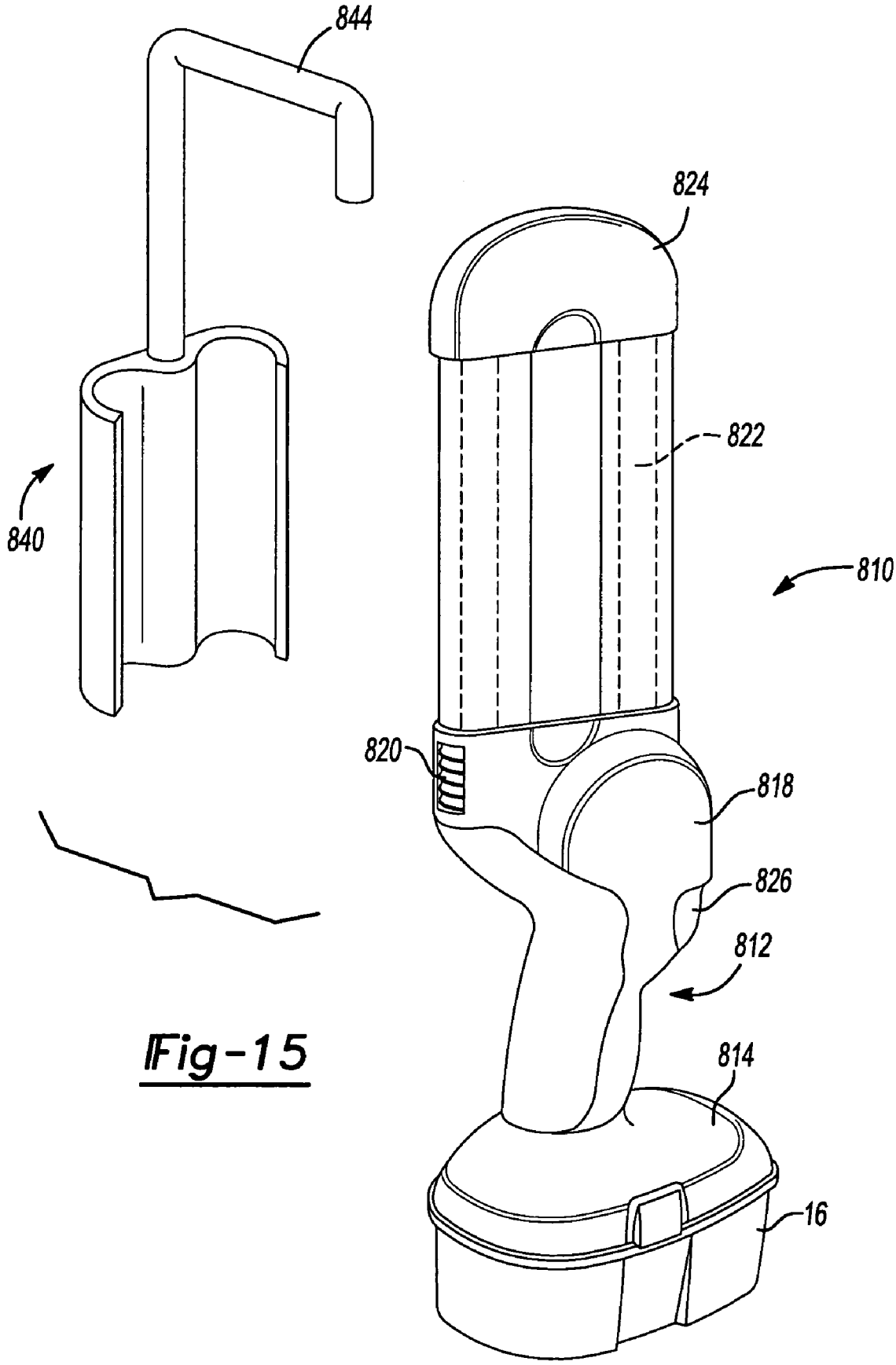
FIG. 15 is a perspective view of the cordless light shown in FIG. 14 with the light arranged in a vertical position with an integral shade and hook according to the principles of the present disclosure.

With reference to FIGS. 14 and 15, a cordless light 810, according to a still further embodiment of the present invention, will now be described. The cordless light 810 includes a handle portion 812 having a first end 814 connected to a battery pack 16. The handle 812 includes a second end defining a yoke 818 which pivotally receives a pivot joint portion 820 which supports a lens portion 822. A cap 824 is mounted to the end of the lens 822.

The handle 812 is configured as a pistol grip including a trigger 826 which activates a switch for providing an electrical connection between the battery pack 16 and a pair of bulbs 828 connected to the pivot joint portion 820. The yoke 818 and pivot joint portion 820 define a pivot to allow the lens 822 to be pivoted approximately 180° so that the light can be directed in a desired location. The pivot joint 820 and yoke portion 818 are provided with detents which are molded into the plastic. Alternatively, the detent mechanism can be formed from a leaf spring or a ball and spring mechanism which engage recesses in the pivot joint portion 820.

With reference to FIG. 15, a shade 840 having a generally C-shaped cross-section is provided that can be snapped onto the lens 822, a hook 844 is integrally formed with the shade 840 in order to allow the cordless light 810 to be suspended therefrom.

Figure 16:
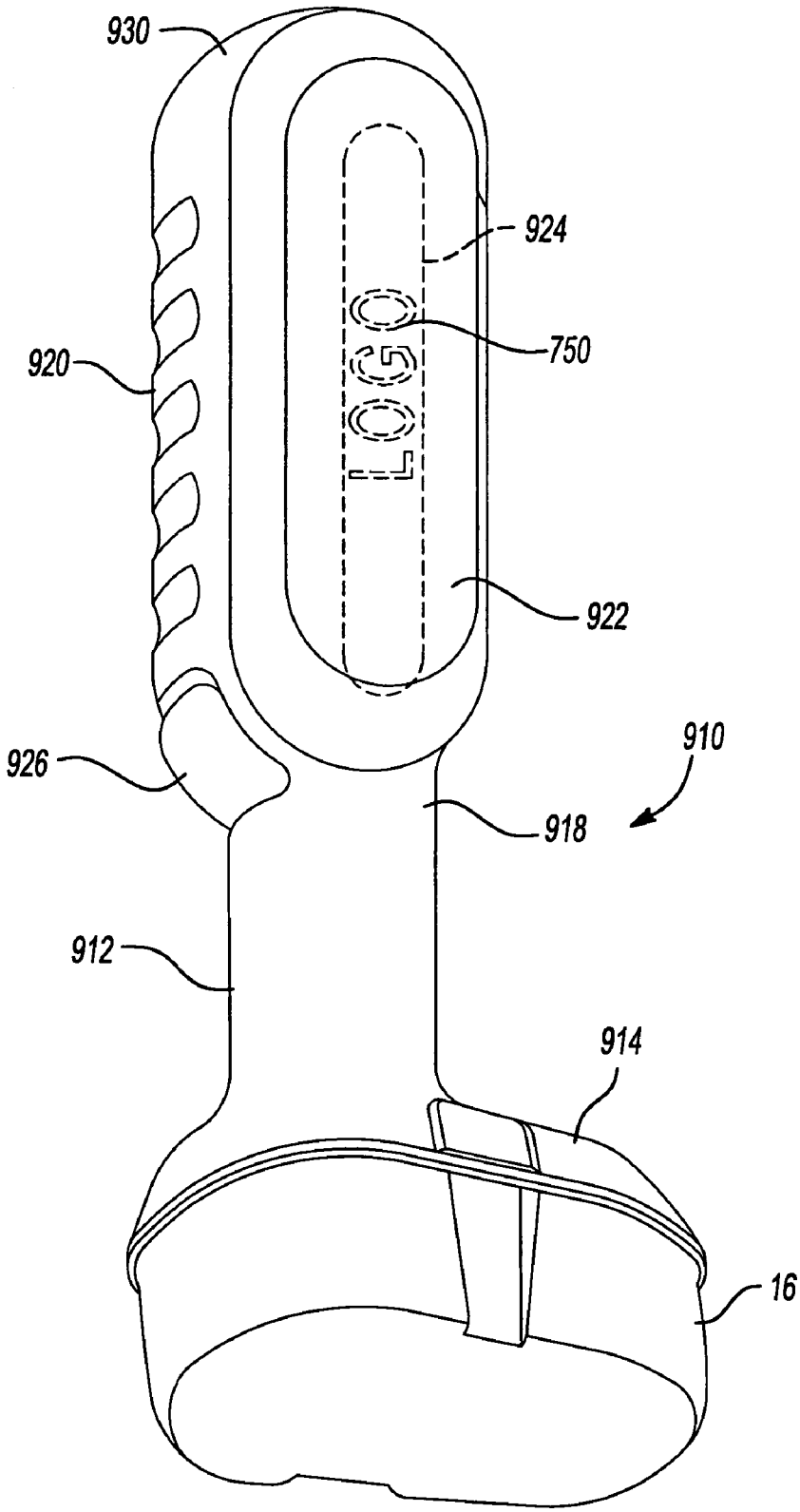
FIG. 16 is a perspective view of yet another embodiment of a cordless light according to the principles of the present disclosure.
Figure 17:
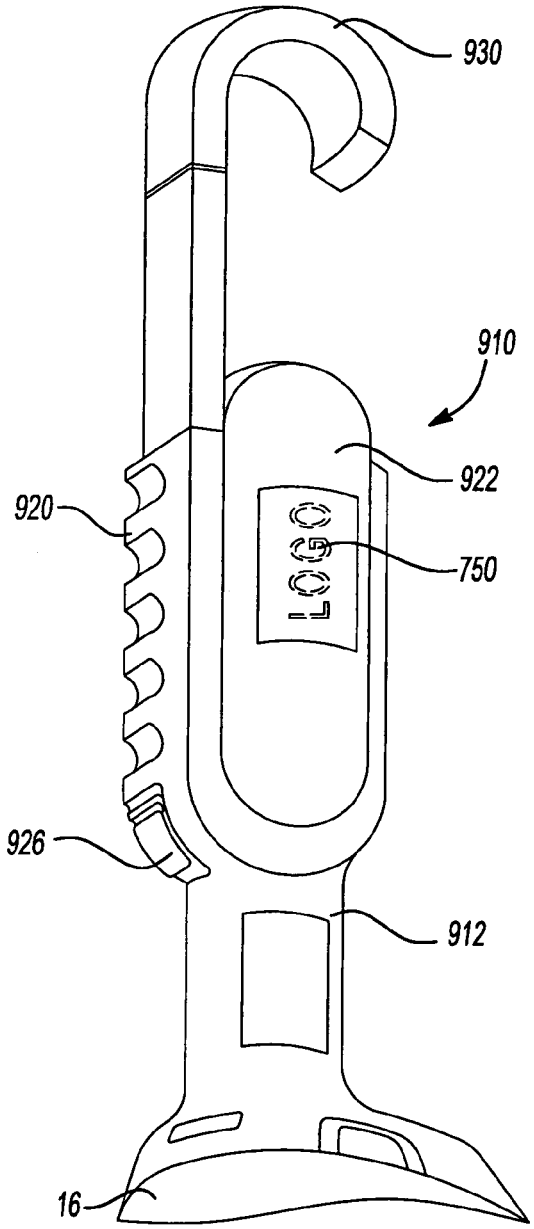
FIG. 17 is a side view of the cordless light of FIG. 16.
Figure 18:
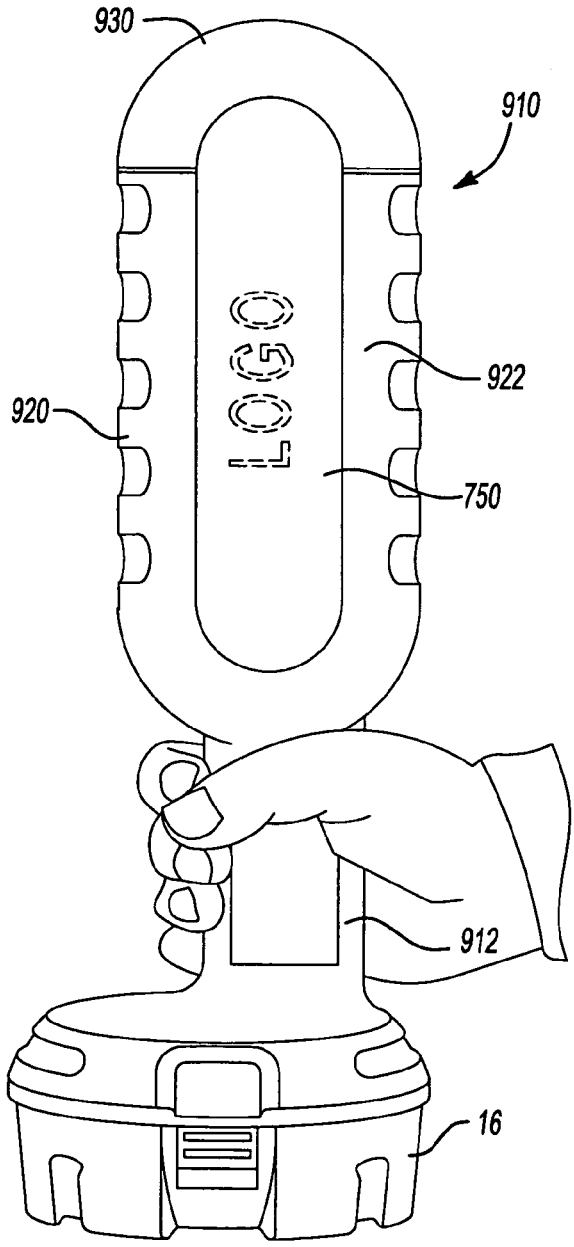
FIG. 18 is a perspective view of the cordless light of FIG. 16 with an integral hook extended to an operative position according to the principles of the present disclosure.

With reference to FIGS. 16-18, a cordless light 910, according to a third embodiment of the present invention, will now be described. The cordless light 910 includes a handle portion 912 having a first end 914 connected to a battery pack 16. The handle 912 includes a second end 918 including a shade portion 920 integrally formed therewith. A lens 922 is mounted to the shade 920. A bulb 924 is connected to the second end 918 of the handle 912 and a switch 926 is disposed between the handle portion 912 and shade 920. The switch 926 provides an electrical connection between the bulb 924 and battery pack 16. As illustrated in FIG. 18, a hook 930 is slidably received in the shade portion 920 and can be extended in order to provide a hook for suspending the cordless light 910 therefrom. The hook 930 is retractable to the position as shown in FIGS. 16 and 17 for enclosing the end of the lens 922. The end of the hook 930 can be overmolded with rubber in order to provide a bumper portion for protecting the lens 922 from impact.

As illustrated in FIGS. 11-13 and 16-18, the lens 722, 922 can be provided with a logo 750 molded into the lens.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A portable light, comprising:

a housing having a retractable hook assembly and a bulb socket in which a bulb is disposed;

the retractable hook assembly including an axially slidable and rotatable hook rod that extends out through an end of the housing and has a hook at a distal end disposed outside the housing and a latch that holds the slidable hook rod in one of a plurality of rotational positions when the hook rod is in an extended position, the hook at the distal end of the hook rod in spaced relation with the end of the housing through which the hook rod extends when the hook rod is in the extended position, the hook is flush with the housing when the hook rod is in a retracted position.

2. The apparatus of claim 1 wherein the latch also holds the hook rod in a retracted position.

3. The apparatus of claim 1 wherein the latch includes a first cylindrical member affixed within the housing at the end of the housing through which the hook rod extends and a second member affixed to the hook rod, the first member having a plurality of inwardly opening detents spaced therearound and the second member including an orientation projection that is received in at least one of the detents when the hook rod is in the extended position.

4. The apparatus of claim 1, wherein said housing includes a base portion and a lamp portion releasably attached to said base portion.

5. The apparatus of claim 4, wherein said base portion includes a switch for electrically connecting said bulb to a battery.

6. The apparatus of claim 4, wherein said lamp portion is connected to said base portion by a bayonet coupling.

7. The apparatus of claim 4, wherein said lamp portion includes a lens disposed adjacent to said bulb.

8. The apparatus of claim 1,further comprising a battery pack releasably attached to said housing.

9. The apparatus of claim 4, wherein said base portion defines a handle.

* * * * *